US008480323B2

(12) United States Patent
Gregory et al.

(10) Patent No.: US 8,480,323 B2
(45) Date of Patent: Jul. 9, 2013

(54) EXPANDABLE WRITING INSTRUMENT

(75) Inventors: Rebecca Gregory, Wrentham, MA (US); George Reekie, Bristol, RI (US); Michael Roberts, Tiverton, RI (US); Donald Santos, Rehoboth, MA (US); Frank Torngren, Attleboro, MA (US)

(73) Assignee: A.T.X. International, Inc., Lincoln, RI (US)

( * ) Notice: Subject to any disclaimer, the term of this patent is extended or adjusted under 35 U.S.C. 154(b) by 699 days.

(21) Appl. No.: 12/771,509

(22) Filed: Apr. 30, 2010

(65) Prior Publication Data

US 2011/0268491 A1 Nov. 3, 2011

(51) Int. Cl.
*B43K 24/04* (2006.01)
*B43K 24/00* (2006.01)

(52) U.S. Cl.
USPC ..... 401/117; 401/116

(58) Field of Classification Search
USPC ..... 401/78, 79, 87, 116, 117
See application file for complete search history.

(56) References Cited

U.S. PATENT DOCUMENTS

| | | | | |
|---|---|---|---|---|
| 544,609 | A | | 8/1895 | Bowman |
| 2,941,511 | A | | 6/1960 | Cieremans |
| 3,084,671 | A | | 4/1963 | Dottlinger |
| 3,597,100 | A | | 8/1971 | Ganz |
| 3,579,318 | A | | 7/1972 | Liguori |
| 3,709,619 | A | | 1/1973 | Zepell |
| 3,792,931 | A | | 2/1974 | Ganz |
| 4,025,204 | A | | 5/1977 | Hobbs |
| 4,529,328 | A | | 7/1985 | Wacha et al. |
| 4,533,271 | A | | 8/1985 | Sansevero |
| 4,601,599 | A | | 7/1986 | Katoh |
| 4,629,348 | A | | 12/1986 | Hashimto |
| 5,022,772 | A | | 6/1991 | Kageyama et al. |
| 5,048,991 | A | * | 9/1991 | Guo ..... 401/116 |
| 5,056,947 | A | | 10/1991 | Kubota et al. |

(Continued)

OTHER PUBLICATIONS

International Search Report of International Application No. PCT/US2011/027560.

*Primary Examiner* — David Walczak
*Assistant Examiner* — Bradley Oliver
(74) *Attorney, Agent, or Firm* — Notaro, Michalos & Zaccaria P.C.

(57) ABSTRACT

An expandable writing instrument has a writing end body section and a rear body section mounted to the writing end body section for relative axial and non-rotational movement between an extended position with the rear body section spaced away from the writing end body section, and a retracted position with the rear body section closer to the writing end body section. A spring in the writing end body section biases the cartridge upwardly. A helix cylinder is mounted for rotation and axial movement in the rear body section with a peg of the rear body section sliding in a track of the helix cylinder. The track is a closed loop with left and right hand helixes so that axial movement of the rear body section causes rotation of the helix cylinder continuously in one rotational direction. A shuttle receives a cartridge body and is mounted for axial movement in the helix cylinder. A shuttle cam on the shuttle is mounted for axial non-rotational movement to the writing end body section. Shuttle cam surfaces slidably engage cam surfaces of the helix cylinder and the cam surfaces include a high point that engages a flat portion of another cam surface for moving the shuttle with rotation of the helix cylinder, to project a writing tip of a cartridge out of the bottom opening in the extended position.

20 Claims, 5 Drawing Sheets

U.S. PATENT DOCUMENTS

| | | | | |
|---|---|---|---|---|
| 6,146,038 | A | 11/2000 | Mittersinker et al. | |
| 6,273,627 | B1 | 8/2001 | Mittersinker et al. | |
| 6,276,855 | B1 | 8/2001 | Hsien | |
| 6,497,524 | B1 * | 12/2002 | Kim | 401/116 |
| D477,025 | S | 7/2003 | Morrow | |
| 6,764,239 | B2 * | 7/2004 | Kim | 401/116 |
| 6,832,868 | B2 | 12/2004 | Hertwig | |
| 6,921,225 | B1 | 7/2005 | Hsu | |
| 6,942,411 | B2 | 9/2005 | Kato | |
| 7,066,042 | B2 | 6/2006 | Andrews | |
| 7,147,392 | B2 | 12/2006 | Bedhome et al. | |
| 7,329,063 | B2 | 2/2008 | Kato | |
| 7,452,149 | B2 | 11/2008 | Saito | |
| 7,527,445 | B2 | 5/2009 | Kanari et al. | |
| 8,079,767 | B2 * | 12/2011 | Rolion et al. | 401/117 |
| 2003/0095825 | A1 * | 5/2003 | Choi | 401/117 |
| 2005/0276652 | A1 | 12/2005 | Kanari et al. | |
| 2008/0317541 | A1 | 12/2008 | Journe | |

* cited by examiner

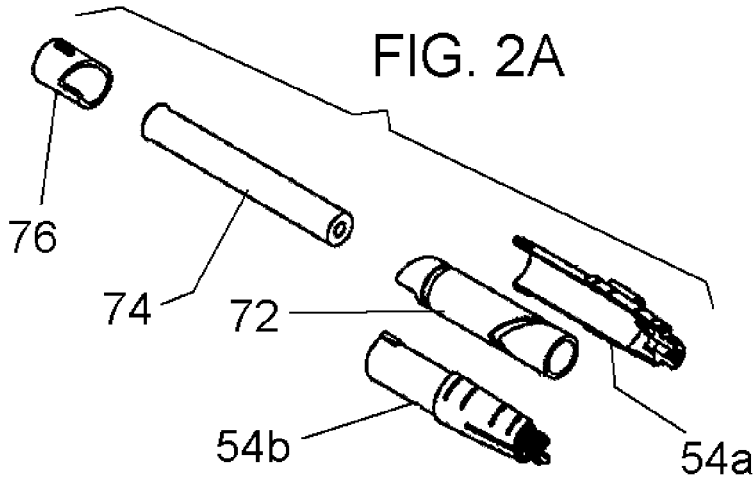
FIG. 2A
FIG. 2B
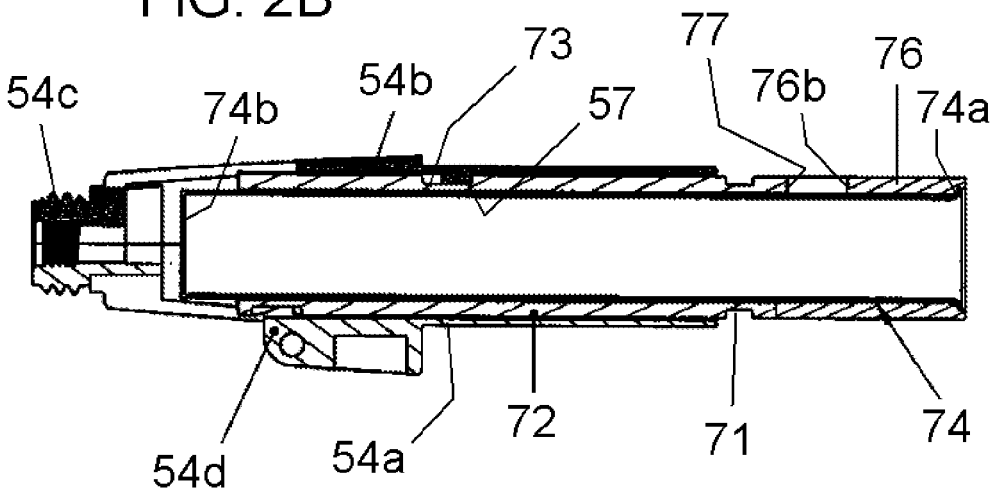
FIG. 2C
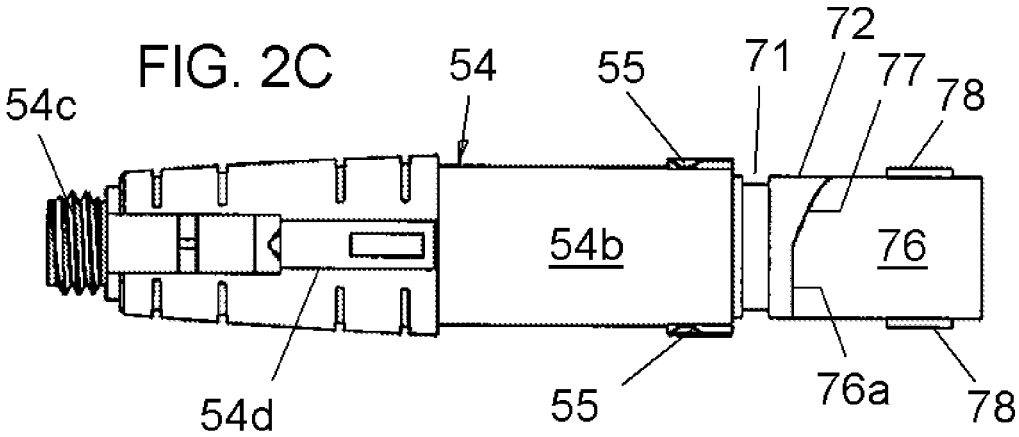

EXPANDABLE WRITING INSTRUMENT

FIELD AND BACKGROUND OF THE INVENTION

The present invention relates generally to writing instruments including but not limited to pens, pencils, styluses and markers, and in particular, to a new and useful expandable writing instrument in the form of a mechanical pen, pencil, stylus or marker that has a compact closed position for storage and carry, and an extended open position for comfortable writing.

As disclosed and discussed in U.S. Pat. No. 6,273,627 assigned to A.T.X. International, Inc., compact devices of all types are sometimes preferred over full-size versions because they occupy less space. However, some compact devices are not as useful as full-sized versions of the same product for a variety of reasons. In the case of writing instruments, a small or reduced size pen can be difficult to hold and use for many people, including the elderly, children, the infirm, and people with large fingers. At the same time, a pen or pencil which occupies less space is more easily carried in a pocket or purse. Sometimes, pens and pencils are sized to fit with other products they are used with, such as a miniature pen provided with a date planner or a golf pencil stored on the steering wheel of a golf cart. These smaller pens and pencils are non-refillable and must be discarded when the ink or lead is used up. While these writing instruments are a compact, convenient size for storing, they are not as comfortably for writing with and suffer the problem that they can be difficult for some persons to use.

If an expandable and retractable writing instrument is desired that also is capable of extending its writing tip for use and retracting it for storage, some further mechanism is needed to permit both actions. U.S. Pat. No. 6,273,627 discloses an expandable pen with the capacity that has a pen body, a front barrel threaded to the pen body and a cap and cap liner that are slidably mounted on the pen body. A cam is rotatably connected inside the pen body at the back end of a refill cartridge for rotation about an axis that is transverse to the main instrument axis. The cam has a rounded surface at one end and a tooth at the other. Pulling the front barrel and the cap in opposite directions causes a ledge in the cap liner to contact the cam tooth and force the cam to rotate downwardly so that the rounded surface of the cam contacts the refill cartridge and forces the refill to move forwardly and past a writing point opening the pen body.

U.S. Pat. No. 7,066,042 assigned to Sanford (Sanford '042) is directed to an advancing/retracting mechanism for a writing instrument which includes a pair of cams and a barrel having a helical surface and a slot. The cams have facing angled surfaces. The first cam has a tab that rides on the helical surface of the barrel and a post. The second cam has a slider which slidably engages the slot of the barrel. In the retracted position, the first cam and second cam are nested. The first cam is moved by applying a force to the post which causes the tab of the first cam to ride on the helical shaped surface. The movement of the tab, in turn, causes the first cam to rotate relative to the barrel and move linearly toward the bottom of the barrel. The first cam moves the second cam until the cams are in an extended position where their tips abut. The second cam transmits the axial motion to an ink refill.

Although the Sanford '042 patent discloses two cams having matching cam edges that are nested together when the writing instrument is closed, this patent does not disclose or suggest a cam geometry nor a helix track of the subject invention. Further, although the Sanford '042 patent discloses a helical surface for a cam follower, there is no teaching or suggestion of a continuous helical loop of the helix cylinder. In addition, as will be explained later in this disclosure, the retracting/expansion mechanism of the subject invention works by pulling the cap away from the pen body which causes a helix cylinder to rotate relative to a shuttle cam for extending the pen. In contrast, with respect to the Sanford '042 patent, a pushing force activates rotation of the first cam for extending the writing instrument. The mechanism of the Sanford '042 patent, moreover, uses a notch in the barrel that engages the slider of the second cam for retaining the writing instrument in an extended position. Releasing the notch, causes the first cam to rotate in a reverse direction and the tab of the first cam to ride on the same helical path until the writing instrument is closed. In contrast, a nub in the cap liner of the subject invention does not travel in reverse on the same path when the pen changes from the extended state to the retracted state. Rather, the nub travels on a left helical track which is missing altogether from the Sanford '042 patent.

U.S. Pat. No. 7,329,063 assigned to Katoh Kinzoku Kougyo Kabushiki Kaisha (Katoh '063) discloses an extendable/contractible writing instrument including a body with a cap at one end that can be attached and detached, a sheath that slides freely on a posterior narrow body section of the body, a slotted rotating shaft on the inside of the body that is fixed to the posterior portion of sheath through top cap, a slotted lead chamber inside rotating shaft which is loaded with an ink refill and an attached casing that is connected to a posterior narrow portion of a lead chamber. By rotating or twisting the body and sheath to extend each from one another, a rotational movement is imparted to the rotating shaft which is converted into the linear movement of the lead chamber and the attached casing, such that the ink refill protrudes from a hole in cap. At the same time and by further rotation and extension of the body and sheath, the attached casing moves in the direction of opening of top end cap and an auxiliary tool such as a silicon gum eraser, that is attached to the tip of casing, protrudes from opening in the top end cap.

U.S. Pat. No. 6,942,411 also assigned to Katoh is directed to a telescopic ball-point pen having an interior surface of a body and a corresponding exterior surface of a sliding axial tube which form a driver screw portion that permits the sliding axial tube to slide back and forth within the body. An interior surface of the sliding axial tube and a corresponding exterior surface of a refill tank form a follower screw portion which permits the refill tank to slide back and forth within the sliding axial tube. A pen refill is received within the refill tank. At a rear end of the sliding axial tube, a sheath and a cap are provided, both of which are configured to rotationally slide along a connection portion of the body. When the sheath and the body are rotated, they are moved away from each other, or closer together, and at the same time, the pen tip of the ball-point pen refill within the refill tank is projected beyond, or received within the writing point.

U.S. Pat. No. 3,679,318 to Liguori discloses a plunger for a writing instrument having a top cam with a wall and an inclined face. A cam follower moves on the cam surface and advances the plunger and the refill cartridge element attached to the plunger when the barrel is rotated.

U.S. Pat. No. 4,533,271 to Sansevero (Sansevero '271) is directed to a writing instrument having two ink refills which uses a tubular cam having two diametrically opposed helical slots whose upper and lower terminations are adjacent. The cam together with cam followers positions one ink refill in the extended position and the second ink refill in the retracted position.

A need remains for a new and improved expandable writing instrument that has a compact closed position for storage and carry, and an extended open position for comfortable writing, and that automatically extends its writing tip from the instrument's front body section, smoothly and effortlessly when the instrument is expanded to its open position.

SUMMARY OF THE INVENTION

It is an object of the present invention to provide a writing instrument with a helix cylinder having a track formed by approximately 180 degrees of a right handed helix and approximately 180 degrees of a left handed helix which are joined to form a continuous 360 degree closed loop track, and a cam surface formed by a sloping wall with a substantially ninety degree cutout, and a shuttle cam having a sloping top edge that nests with the sloping wall of the helix cylinder when the pen is in a retracted position, and a flat top edge that extends approximately 180 degrees of the shuttle cam's circumference and abuts the bottom edge of the sloping wall of the helix cylinder when the writing instrument is in its open position.

Another object of the invention is to provide an expandable writing instrument comprising a writing end body section and a rear body section mounted to the writing end body section for relative axial and non-rotational movement between an extended position with the rear body section spaced away from the writing end body section, and a retracted position with the rear body section closer to the writing end body section, a spring in the writing end body section for biasing the cartridge upwardly, a helix cylinder mounted for rotation and axial movement in the rear body section with a peg of the rear body section sliding in a track of the helix cylinder, the track being a closed loop with left and right hand helixes so that axial movement of the rear body section causes rotation of the helix cylinder continuously in one rotational direction, a shuttle for receiving a cartridge body of the cartridge, mounted for axial movement in the helix cylinder, a shuttle cam on the shuttle mounted for axial non-rotational movement to the writing end body section, shuttle cam surfaces being slidably engage to cam surfaces of the helix cylinder and the cam surfaces including a high point that engages a flat portion of another cam surface for moving the shuttle with rotation of the helix cylinder, to project a writing tip of a cartridge out of the bottom opening in the extended position.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 2A is an exploded view of the cam and helix components of the instrument of FIG. 1, in a closed compact position;

FIG. 2B is an axial sectional view of the assembled components of FIG. 2A in the closed position;

FIG. 2C is a front view of the assembled components of FIG. 2A in the closed position;

DESCRIPTION OF THE PREFERRED EMBODIMENTS

Figure 1:
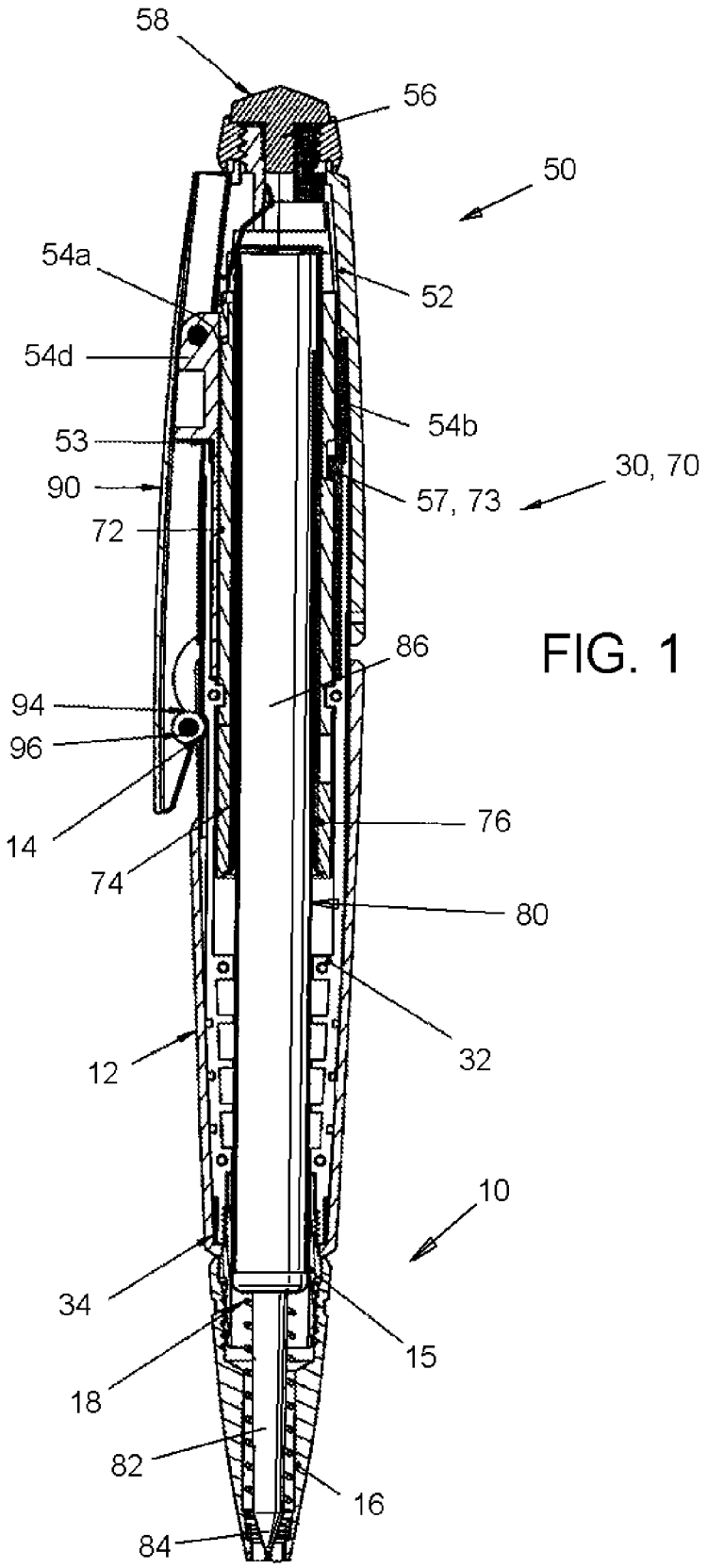
FIG. 1 is an axial sectional view of an embodiment of the improved expandable writing instrument of the invention.
Figure 4:
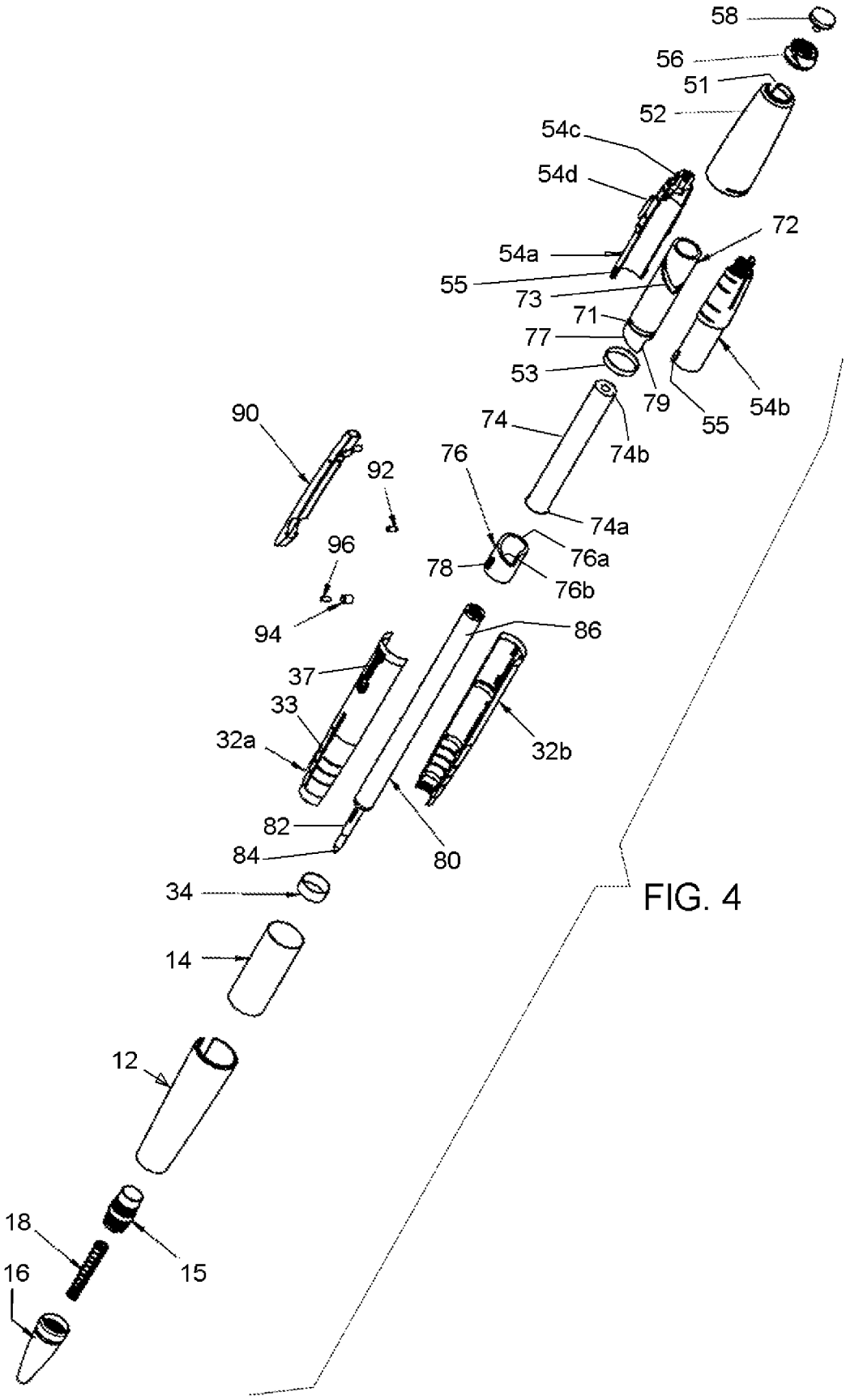
FIG. 4 is an explodes perspective view of the expandable writing instrument of FIG. 1.

Referring now to the drawings, in which like reference numerals are used to refer to the same or similar elements, FIGS. 1 and 4 illustrate an improved expandable writing instrument comprising a bottom or writing end body section 10, a middle body section 30, a rear body section 50 and a cam mechanism 70.

The writing end body section 10 is made up of a plastic barrel 12, a decorative and functional brass sleeve 14, a plated brass writing point 16 and a spring steel writing point spring 18. The middle body section 30 comprises a chassis 32 shown in FIG. 1, made up of right and left plastic chassis portions 32*a* and 32*b* shown in FIG. 4. A metal chassis sleeve 34 holds the bottom ends of the chassis portions 32*a* and 32*b* together and the decorative sleeve 14 that is slidable over the chassis 32 also help keep its two portions 32*a*, 32*b* together as well. The point 16 is threaded onto a plated brass point adaptor 15 which, in turn, is threaded into the connected together upper end of the two part chassis 32, to fix the point 16 to the chassis and to fix the barrel 12 in place so that point 16, adapter 15, barrel 12 and chassis 32 form one assembly that moves together as one.

The rear body section 50 comprises an outer cap 52 of plastic, a two part plastic cap liner 54 and a decorative top 56 of brass with a brass accent 58 screwed into the top 56. Cap liner 54 has front and rear liner portions 54*a* and 54*b* that are held together by a metal liner sleeve 53. Cam mechanism 70 comprises an acetal (e.g. Delrin® brand acetal) helix cylinder 72 and a shuttle cam assembly made up of a plates brass shuttle 74 that has a lower outwardly flaring flange 74*a* for trapping a lower plastic shuttle cam 76 against sliding off the lower end of shuttle 74. The shuttle cam assembly 74, 76, is housed in the chassis 32 and in the cap liner 54, for relative axial non-rotatable movement of the shuttle 76 in the chassis 32 because of a pair of opposite rectangular shuttle cam tabs 78 that slide in respective opposite chassis slots 33 in the respective chassis portions 32*a* and 32*b*. Relative axial and non-rotatable movement of cap liner 54 in the chassis 32 is maintained by a pair of opposite rectangular liner tabs 55 in the outer surface on the lower part of the liner portions 54*a* and 54*b*, that slide in respective opposite liner slots 37 in the respective chassis portions 32*a* and 32*b*.

Figure 3A:
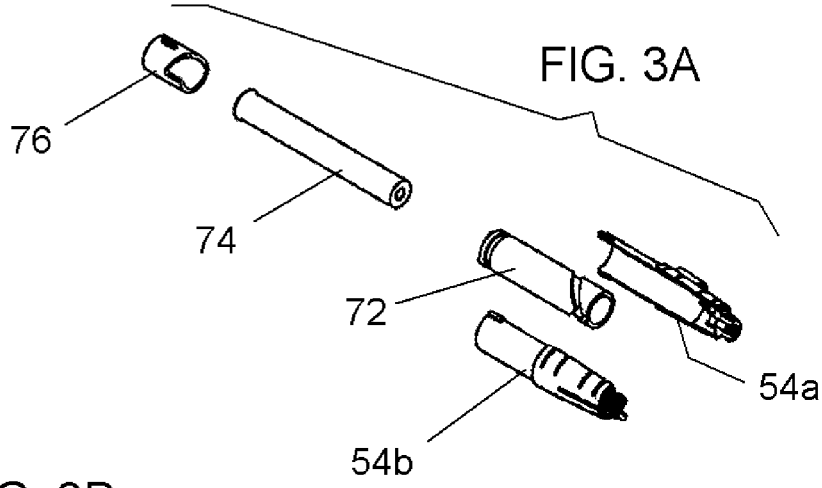
FIG. 3A is an exploded view of the cam and helix components of the instrument of FIG. 1, in an open expanded position.
Figure 3B:
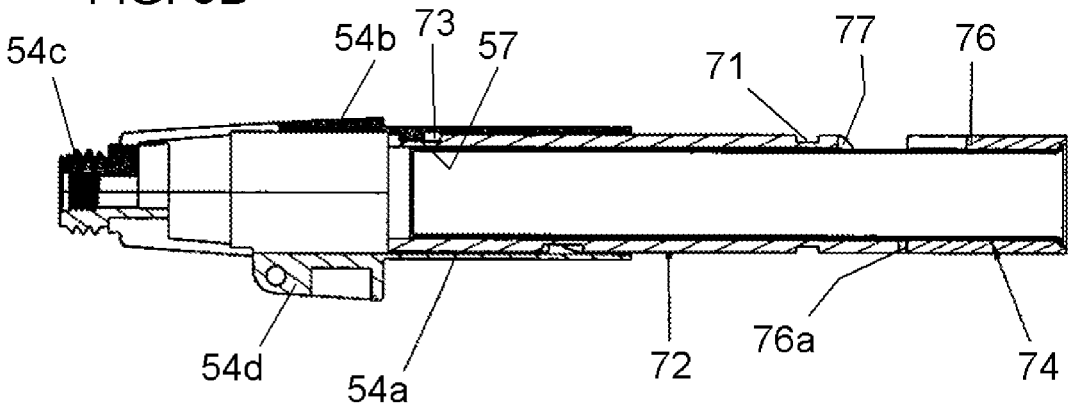
FIG. 3B is an axial sectional view of the assembled components of FIG. 3A in the open position.
Figure 3C:
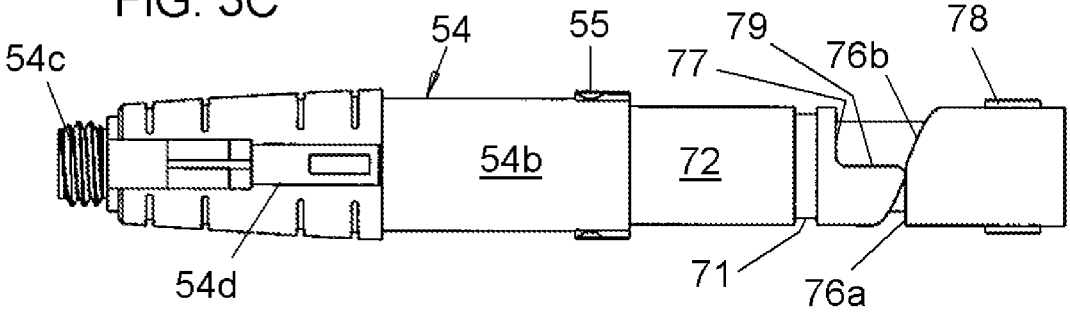
FIG. 3C is a front view of the assembled components of FIG. 3A in the open position.

There is also a slight indentation in each of the tabs 55 which is visible in FIGS. 2C and 3C, and that slide in the respective chassis slots 37. These indentations engage opposite bumps or constrictions at the opposite ends of the chassis slots 37 that are visible in FIG. 4 so that the indentations in the tabs 55 act as light detents at the extremes of the cap movement. Because of this detent action, the user feels a light click when the pen is fully extended or fully retracted. This feature also prevents the cap from floating in the extended position, as the peg 57 would otherwise be free to move axially in the track 73 and cause the cap to rattle.

A writing cartridge or refill 80 of known A. T. Cross design for ink gel is captures in the shuttle 74 which also has an inwardly extending upper flange 74*b* that at least partly closes the upper end of the shuttle 74 leaving an opening at the center for easier entree and exit of the refill body to be housed in the shuttle. In the expanded open position of the instrument, a small diameter writing end 82 of the refill 80 is biased upwardly by spring 18 into the shuttle 74 and against the flange 74*b* to prevent undesired movement of the refill 80. In this open position of the writing instrument, the writing tip 84 projects from the open lower end of writing point 16 for use of the instrument for writing. Because of the design of this improved expandable writing instrument, a standard gel refill 80 having an overall length of 4⅜ inches and a large diameter reservoir 86 of ¼ inch can be used, despite the retractable length of the instrument from its expanded open length of about 6¾ inches to its contracted closed length of about 5 inches.

The cap 52 is designed to open and close the writing instrument by telescoping action. When the cap is pulled longitudinally away from the pen body 10, 30, the writing tip 84 of the writing cartridge 80 extends outwardly and the writing instrument is in its open position. When the cap 52 is pushed back toward the pen body, the writing tip 84 retracts.

The outer cap 52 has a substantially cylindrical shaped body with a vertical slot 51 that extends its entire length. The outer cap sits on and is attached to the cap liner 54. The cap liner is a hollow cylindrical body that is received inside the outer cap. The cap liner 54 has a top exterior threaded end 54*c* that is threaded into the brass top 56, and a bottom open end. The rectangular tabs 55 extend on the exterior surface at approximately 180 degrees near the bottom opening of the cap liner. A clip mounting tab 54*d* extends on the top exterior surface of the front liner portion 54*a* and is secured between the side edges of the cap slot 51 so that the outer cap 52 and the cap liner 54 move and act as one piece. A clip 90 is secured by a pin 92 to the clip tab 54*d*. For smooth clip action on a pocket or other thin flat material, the opposite end of clip 90 has a roller 94 mounted to the clip 90 by a further pin 96. The clip roller 94 also prevents the clip from scratching the decorative sleeve 14. An integral square or diamond shaped peg 57 on the inner surface of the rear cap liner portion 54*b* rides in a helical track 73 of the helix cylinder 72 for rotating the helix cylinder 72 then the cap 52 is pulled to the open or extended position from the barrel 12.

Figure 6:
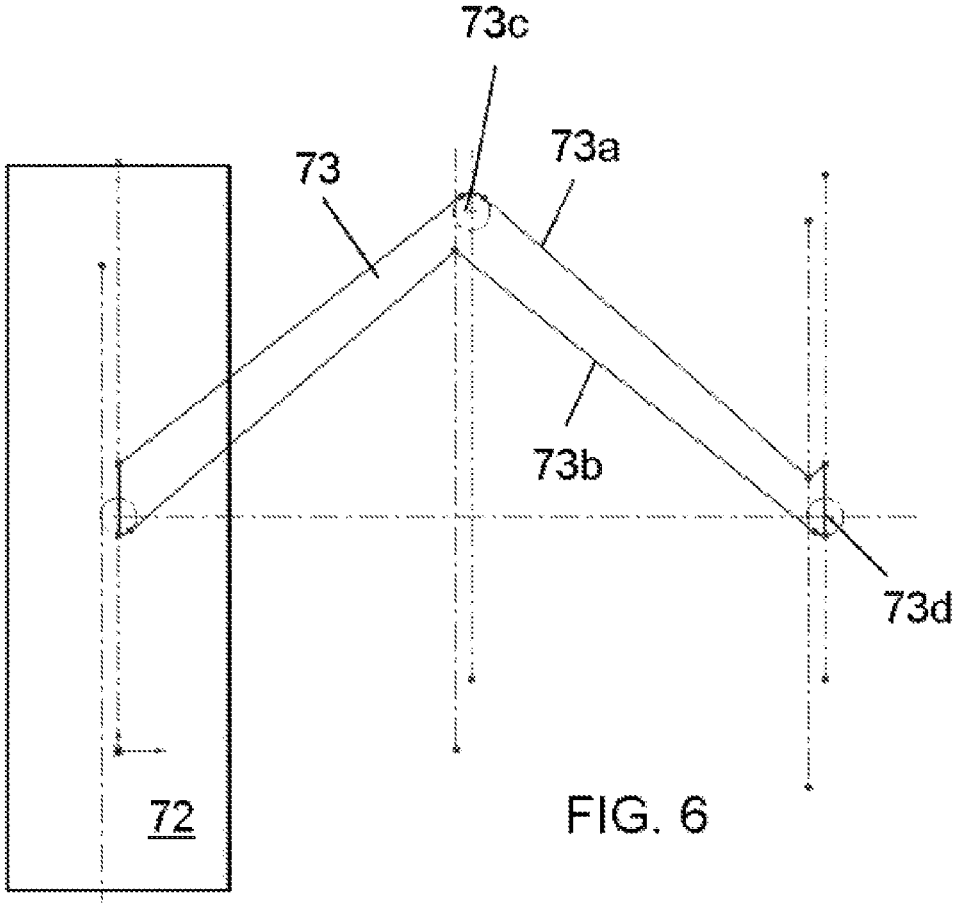
FIG. 6 is a developed view of the track geometry of the left and right helix in the helix cylinder.

The helix cylinder 72 has a cylindrical body that is received in the proximate end of the cap liner 54. The helix cylinder 72 is fully retracted in the cap liner 54 when the pen is in the closed position shown n FIG. 1. The helix cylinder 72 has track 73 on its exterior surface that is driven by the peg 57 of the cap liner 54. The track has about 180 degrees of right handed helix and about 180 degrees of a left handed helix joined to form a continuous loop around the cylinder 72 as shown in FIG. 6. An extra clearance at the upper and lower apex positions 73*c* and 73*d* between the upper and lower track walls 73*a* and 73*b* of the track 73, is present and is important for proper function of the mechanism and smooth sliding of the peg 57 in the track 73. The helix shape of the upper wall 73*a* of track 73 is also offset by about 8 degrees counter-clockwise with respect to the lower wall 73*d* to insure that the helix cylinder 72 will always and only rotate clockwise then the peg 57 is moved up and down in the track as the rear body section 50 is pulled and pushed with respect to the writing end body section 10 for opening and closing the instrument. This offset angle may be from about 2 to about 12 degrees for example.

Because of this offset, only approximately 180 degrees for right and left hand helix are present on the helix cylinder 72. Due to the offset of the upper and lower track surface as described in paragraph, the helix track surfaces are, for example, as follows: the upper wall or surface may be about 175 degrees left helix and about 185 degrees right helix and the lower wall or surface may be about 185 degrees left helix and about 175 degrees right helix. In addition, the track may be purposefully asymmetrical to achieve different propel/repel characteristics as an alternate embodiment.

The bottom end of the helix cylinder 72 has a circumferentially extending groove 71. An inclined cam wall 77 with a ninety degree cutout 79 extends down from the groove. The shuttle cam 76 has mating cam surfaces that are driven by the cam wall 77, 79 of the helix cylinder 72 then the helix cylinder is rotated by relative axial movement of the cap liner 54, when the cap 52 and barrel 12 are pulled away from each other, to move the shuttle 74 and thereby project the writing tip 84 out through the bottom opening of the writing point 16. The shuttle cam 76 is a generally hollow cylindrical body with a flat top edge 76*a* and a cutout 76*b* that extends from the flat top edge. The flat or radial top edge portion 76*a* extends for approximately 180 degrees of the shuttle cam's circumference. When a high point or area of cam 77 just before the cutout 79 is engaged with the flat portion 76*a* of the shuttle cam 76, the instrument is in its open position and the writing tip 84 of cartridge 80 is projected out through the bottom opening of writing point 16 for writing.

Tabs 78 extend from the side wall at approximately 180 degrees apart proximate the bottom end of the shuttle cam 76. The shuttle 74 is a hollow tube that houses the refill 80. The shuttle has the bottom circumferential lip or flange 74*a* on which the shuttle cam 76 rests. The shuttle cam and the shuttle move as one unit. The shuttle is inserted in the helix cylinder 72. The cam surfaces 77, 79 of the helix cylinder 72 and the shuttle cam 76 are aligned and nested when the writing instrument is in a retracted position as shown in FIGS. 2A, 2B and 2C.

The chassis 32 partially encases the cap liner 54 and the helix cylinder 72 and the shuttle cam 76. The chassis 32 has a cylindrical body with a tapered bottom end. The pair of slots 37 extend on opposite sides of the chassis 32. The slots 33 proximate the bottom tapered end of chassis 32 receive the tabs 78 of the shuttle cam 76, while the slots 37 proximate the top opening of chassis 32 receive the tabs 55 of the cap liner 54. The tabs ride in the slots as the cap 52 is alternately pulled away from and pushed toward the chassis 32. The barrel 12 fits over the chassis 32. The barrel 12 includes a clip window cutout at the top that is aligned with a slot of the front cap liner 54*a*. The spring 18 is housed in the writing point 16 and is in an unstressed state when the writing instrument is in the retracted or closed position.

The writing instrument operates in the following manner. To open the writing instrument, the rear body section 50 including the cap 52 and its liner 54, is pulled away from the writing end body section 10. Because the cap and cap liner move as one, the cap liner peg 57 which is seated within the helix track 73 of the helix cylinder 72, drives the helix cam 77, 79 to rotate clockwise. When the cap 52 reaches its fully open position, the helix cylinder 72 will have completed about a 180 degree clockwise rotation. This position also corresponds with the peg 57 reaching the top apex 73*c* of the helix track.

While this action takes place, the second step, converting the rotation to an axial shift in the shuttle cam, is also taking place.

As the writing instrument is opened, the rotation of the helix cylinder 72 forces the shuttle cam 76 to move downwardly, thus slowly extending the writing cartridge tip 84 out of the writing tip 16. Once the cap is fully extended, the helix cylinder will have rotated onto the flat top edge 76*a* of the shuttle cam 76 thus preventing it from back driving when pressure is applied to the writing tip.

Due to the extra clearance at the track apex 73*a,* when a downward force is applied to the cap 52, the peg 57 of the cap liner 54 will engage the left hand portion of the helix track 73, thus forcing continued clockwise rotation for an additional 180 degrees, approximately. While this action takes place, the shuttle cam 76 relays this motion to the writing tip. This will eventually cause the spring 18 that is around the small diameter writing end 82 and bears against the large diameter reservoir 86, to push the refill 80 back up, out of the writing point 16 and deep into the shuttle 74 as will be explained below.

The geometry of the shuttle cam controls the writing cartridge action during the act of closing the pen. The helix cylinder continues to rotate clockwise along the flat top edge until just prior to reaching the fully closed position. This corresponds to no axial movement of the shuttle cam. The writing tip 84 remains extended until just before reaching the fully closed position. As the fully closed position is approached, the bottom edge of the cam wall of the helix cylinder encounters the sudden change in the shuttle cam geometry, which causes the writing tip to snap back suddenly through force of the point spring 18. The refill writing tip's sudden retraction indicates that the pen is now fully closed and ready to repeat the cycle again. The cam edges return to their nested relation as shown in FIG. 2C.

As long as the pen cap is moved from fully open to fully closed (and vice versa) then the helix cylinder 32 will always rotate clockwise, regardless of the direction of pull. However, if the cap is only opened halfway, and then closed, then the peg 57 will backtrack and the helix cylinder will begin rotating counter-clockwise. The only effect of this from the user's point of view will be that the writing tip will slowly retract instead of snapping in suddenly, per design intent. The action of the peg 57 reaching the end of the left handed helix 73 and the completion of the approximately 180 degree rotation occur when the cap reaches its fully closed position.

Figure 5:
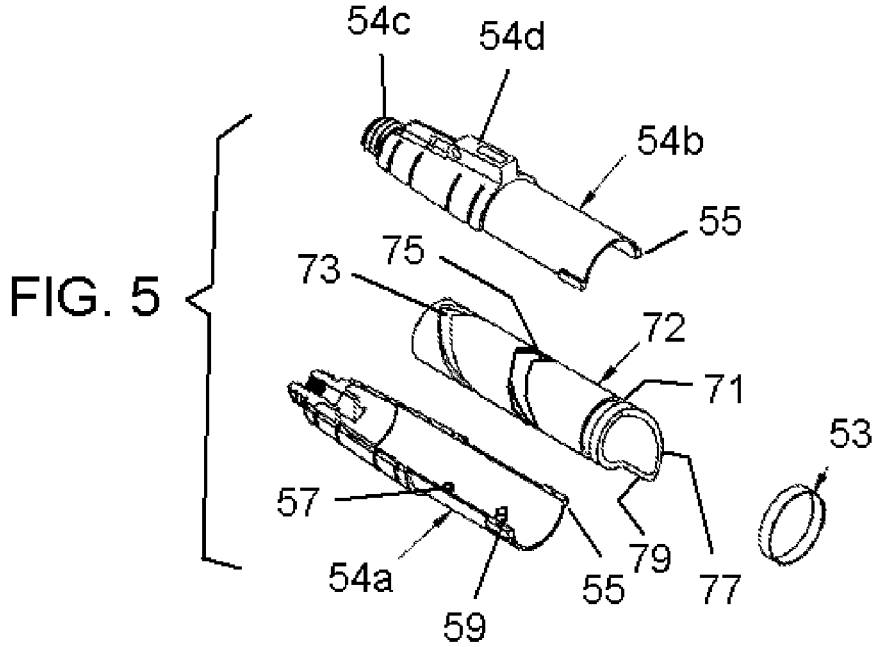
FIG. 5 is an enlarged exploded perspective view of cap liner and helix cylinder components of another embodiment of the instrument of FIG. 1.

Another embodiment of the design is shown in FIG. 5 where the cap liner rear portion 54*b* has two pins or diamond shaped pegs 57 and 59 instead of one, corresponding to two helical tracks 73 and 74 in the helix cylinder 72. The second pin 59 and track 75 are offset from the first towards the writing tip of the instrument. The second track 75 is slightly wider than the first track 73, so that, under normal operation, only one pin-plus-track (57, 73) is in contact and serves to drive the refill. The second pin 59 and track 75 serves as an additional stop to prevent the instrument from being pulled apart. As the pen is pulled and the first pin begins to slide up the track wall and out of its track, the second pin comes into contact with its track and prevents the pen from being pulled apart. In this case, "pulled apart" means that the pen will undesirably split into two pieces, that is the cap and cap liners being separated from helix cam, chassis portions and barrel. Additionally, the second track and pin serve as a fail safe in case the first pin is worn or damaged.

Alternatively to a square or diamond shaped peg 57 or pegs 57 and 59, the peg or pegs may be triangular or round or any shape that can slide along the helix 73 and helixes 73 and 75, freely.

While specific embodiments of the invention have been shown and described in detail to illustrate the application of the principles of the invention, it will be understood that the invention may be embodied otherwise without departing from such principles.

What is claimed is:

1. An expandable writing instrument for receiving a cartridge having a writing tip and a cartridge body, comprising:

a writing end body section (10) having a barrel with a writing point including a bottom opening;

a middle body section (30) fixed to the writing end body section;

a rear body section (50) having a cap and liner in the cap, the rear body section being mounted to the middle body section for relative axial and non-rotational movement between an open position with the rear body section spaced away from the writing end body section, and a closed position with the rear body section being closer to the writing end body section;

a spring in the writing point for engagement with the cartridge body of the cartridge in the writing instrument for biasing the cartridge upwardly; and a cam mechanism (70) operatively connected between the middle body section and the rear body section;

the cam mechanism comprising:

a helix cylinder (72) mounted to rotate and for axial movement in the liner, the liner having a peg (57) and the helix cylinder having a track (73) for slidably receiving the peg, the track being a closed loop extending entirely around the helix cylinder with a portion of right handed helix and a remainder of left handed helix, the track having offset upper and lower walls so that with axial movement of the rear body section toward and away for the writing end body section, the peg sliding in the track permits rotation of the helix cylinder continuously in one rotational direction, the helix cylinder having cam surfaces; and a shuttle (74) for receiving the cartridge body, mounted for axial movement in the helix cylinder with a shuttle cam (76) engaged to and movable with the shuttle, the shuttle cam being mounted for axial non-rotational movement to the middle body section and having shuttle cam surfaces that are slidably engaged against the cam surfaces of the helix cylinder, the cam surfaces of the helix cylinder having a high point that engages a flat portion of the shuttle cam surfaces for moving the shuttle, with rotation of the helix cylinder, to project the writing tip of a cartridge in the writing instrument, out of the bottom opening of the writing point when the rear body section is in the open position.

2. The expandable writing instrument of claim 1, wherein the middle body section comprises a chassis having left and right portions that are held together by a chassis sleeve around the left and right portions and a decorative sleeve slidably engaged around the left and right portions.

3. The expandable writing instrument of claim 1, wherein the liner includes front and rear liner portions that are held together by a liner sleeve.

4. The expandable writing instrument of claim 1, wherein the shuttle has a lower outward flange for retaining the shuttle cam on the shuttle, and an upper inward flange for retaining a cartridge body in the shuttle.

5. The expandable writing instrument of claim 1, wherein the helix cylinder cam surfaces include an inclined cam wall with a ninety degree cutout extending downwardly from an end of the inclined wall the high point being on the inclined wall, adjacent the ninety degree cutout.

6. The expandable writing instrument of claim 1, wherein the shuttle cam surfaces include the flat top edge and a cutout that extends from the flat top edge.

7. The expandable writing instrument of claim 1, wherein the shuttle cam includes at least one tab that rides axially in an axial slot of the middle body section for maintaining non-rotation of the shuttle cam with respect to the middle body section.

8. The expandable writing instrument of claim 1, wherein the liner includes at least one tab that rides axially in an axial slot of the middle body section for maintaining non-rotation of the line with respect to the middle body section.

9. The expandable writing instrument of claim 1, including a clip connected to the liner.

10. An expandable writing instrument for receiving a cartridge having a writing tip and a cartridge body, comprising:

a writing end body section with a bottom opening for the writing tip in an extended position of the instrument;

a rear body section mounted to the writing end body section for relative axial and non-rotational movement between the extended position with the rear body section spaced away from the writing end body section, and a retracted position with the rear body section closer to the writing end body section;

a spring in the writing end body section for engagement with the cartridge body of a cartridge in the writing instrument for biasing the cartridge upwardly;

a helix cylinder mounted to rotate and for axial movement in the a rear body section, the a rear body section having a peg and the helix cylinder having a track for slidably receiving the peg, the track being a closed loop extending entirely around the helix cylinder with part of the track being a right handed helix and a remainder of track being a left handed helix, the track being shaped so that with axial movement of the rear body section toward and away for the writing end body section, the peg sliding in the track permits rotation of the helix cylinder continuously in one rotational direction, the helix cylinder having cam surfaces; and a shuttle for receiving a cartridge body, the shuttle being mounted for axial movement in the helix cylinder and having a shuttle cam, the shuttle cam being mounted for axial non-rotational movement to a middle body section and having shuttle cam surfaces that are slidably engaged against the cam surfaces of the helix cylinder, the cam surfaces of one of the helix cylinder and shuttle cam having a high point that engages a flat portion of the other of helix cylinder and shuttle cam, for moving the shuttle, with rotation of the helix cylinder, to project the writing tip of a cartridge in the writing instrument, out of the bottom opening when the rear body section is in the extended position.

11. The expandable writing instrument of claim 10, wherein the track has rotationally offset upper and lower walls.

12. The expandable writing instrument of claim 10, wherein including a cap liner in rear body section including front and rear liner portions that are held together by a liner sleeve.

13. The expandable writing instrument of claim 10, wherein the shuttle has a lower outward flange for retaining the shuttle cam on the shuttle, and an upper inward flange for retaining a cartridge body in the shuttle.

14. The expandable writing instrument of claim 10, wherein the helix cylinder cam surfaces include an inclined cam wall with a ninety degree cutout extending downwardly from an end of the inclined wall the high point being on the inclined wall, adjacent the ninety degree cutout.

15. The expandable writing instrument of claim 10, wherein the shuttle cam surfaces include the flat top edge and a cutout that extends from the flat top edge.

16. The expandable writing instrument of claim 10, wherein the middle body section is between the writing end body section and the a rear body section, the shuttle cam including at least one tab that rides axially in an axial slot of the middle body section for maintaining non-rotation of the shuttle cam with respect to the middle body section.

17. The expandable writing instrument of claim 10, including a liner in the rear body section, the liner including at least one tab that rides axially in an axial slot of the middle body section for maintaining non-rotation of the line with respect to the middle body section.

18. The expandable writing instrument of claim 10, including a clip connected to the liner.

19. An expandable writing instrument comprising: a writing end body section and a rear body section mounted to the writing end body section for relative axial and non-rotational movement between an extended position with the rear body section spaced away from the writing end body section, and a retracted position with the rear body section closer to the writing end body section, a spring in the writing end body section for biasing a cartridge upwardly, a helix cylinder mounted for rotation and axial movement in the rear body section with a peg of the rear body section sliding in a track of the helix cylinder, the track being a closed loop with left and right hand helixes so that axial movement of the rear body section causes rotation of the helix cylinder continuously in one rotational direction, a shuttle for receiving a cartridge body of the cartridge, mounted for axial movement in the helix cylinder, a shuttle cam on the shuttle mounted for axial non-rotational movement to the writing end body section, shuttle cam surfaces being slidably engage to cam surfaces of the helix cylinder and the cam surfaces include a high point that engages a flat portion of another cam surface for moving the shuttle with rotation of the helix cylinder, to project a writing tip of a cartridge out of the bottom opening in the extended position.

20. The expandable writing instrument of claim 19, wherein the track has rotationally offset upper and lower walls.

* * * * *